US005885323A

United States Patent [19]

Kim et al.

[11] Patent Number: 5,885,323

[45] Date of Patent: Mar. 23, 1999

[54] FOAMY SLAG PROCESS USING MULTI-CIRCUIT LANCE

[75] Inventors: Chung S. Kim, Hudson, Ohio; Kenneth M. Goodson, Hammond, Ind.

[73] Assignee: LTV Steel Company, Inc., Cleveland, Ohio

[21] Appl. No.: 845,602

[22] Filed: Apr. 25, 1997

[51] Int. Cl.[6] ..... C21C 5/32

[52] U.S. Cl. ..... 75/387; 75/553

[58] Field of Search ..... 75/375, 387, 553, 75/501, 502

[56] References Cited

U.S. PATENT DOCUMENTS

| | | |
|---|---|---|
| 613,598 | 2/1898 | Lilliequist et al. . |
| 3,320,053 | 5/1967 | Lehman . |

(List continued on next page.)

FOREIGN PATENT DOCUMENTS

| | | |
|---|---|---|
| 876526 | 7/1991 | Canada . |
| 98 30 0199 | 5/1985 | European Pat. Off. . |
| 423098 | 4/1991 | European Pat. Off. . |
| 2149023 | 1/1974 | Germany . |
| 2326706 | 12/1974 | Germany . |
| 2433217 | 1/1975 | Germany . |
| 3231867 | 3/1984 | Germany . |
| 51-12320 | 1/1976 | Japan . |
| 61-139616 | 12/1984 | Japan . |
| 5043924 | 2/1993 | Japan . |
| 6-25732 | 2/1994 | Japan . |
| 414312 | 3/1972 | U.S.S.R. . |
| 438702 | 4/1972 | U.S.S.R. . |
| 502950 | 7/1972 | U.S.S.R. . |
| 499315 | 4/1973 | U.S.S.R. . |
| 1395682 | 4/1986 | U.S.S.R. . |
| 1190137 | 4/1970 | United Kingdom . |
| WO 85/02203 | 5/1985 | WIPO . |

OTHER PUBLICATIONS

T. Soejima et al., "Post Combustion in 240T Combined Blowing Converter", presented at the 110th ISIJ Meeting, Lecture No. S1042, p. B–166 (Dec. 1985).

C.S. Kim et al., "BOF Slopping Control", Steelmaking Proceedings, vol. 62, pp. 158–163 (Dec. 1979).

"Investigation of the Effect on Post Combustion in LD Converter", Transaction ISU, vol. 25 (Dec. 1985).

Akira Yashuda et al., "Production of Deep Drawing Quality Steel Sheets for Porcelain Enameling by Continuous Casting", Kawasaki Steel Technical Report,No. 12, pp. 45–54 (Dec. 1985).

J. Repasch et al., "Operating Results Using Post–Combustion Lances At The Bethlehem, PA, BOF Shop", Steelmaking Conference Proceedings, pp. 225–235 (Dec. 1995).

A. Chatterjee, "On some aspects of supersonic jets of interest in LD steelmaking", Part 1 (Dec. 1972).

A. Chatterjee, "On some aspects of supersonic jets of interest in LD steelmaking", Part 2 (Dec. 1973).

*Primary Examiner*—Scott Kastler

*Attorney, Agent, or Firm*—Watts, Hoffmann, Fisher & Heinke Co., LPA

[57] ABSTRACT

A method of improving post-combustion heat recovery in a vessel containing a charge of molten ferrous metal and slag includes the use of a lance for the introduction of oxygen gas into the charge. The method includes blowing oxygen into the charge through at least one first nozzle of the lance for refining the molten metal into steel. Oxygen is blown through at least one second nozzle of the lance from at least one location spaced above the first nozzle at an oxygen flow rate effective to produce foamy slag in an amount for obtaining a post-combustion heat transfer efficiency of at least about 40% without appreciable overflow of the slag from the vessel. The oxygen flow rate from the second nozzle is at a minimum at about a starting point of a peak decarburization period of the charge. Iron oxide containing pellets may also be added to the charge. In this case, the oxygen flow rate from the first nozzle may be reduced while the iron oxide containing material is being added, and the reduced oxygen flow may be replenished with an inert gas.

30 Claims, 1 Drawing Sheet

U.S. PATENT DOCUMENTS

| | | |
|---|---|---|
| 3,356,490 | 12/1967 | Muller et al. . |
| 3,488,044 | 1/1970 | Shepherd . |
| 3,594,155 | 7/1971 | Ramachandran . |
| 3,620,455 | 11/1971 | Berry . |
| 3,653,877 | 4/1972 | Enya . |
| 3,700,429 | 10/1972 | Ramachandran . |
| 3,754,892 | 8/1973 | Ando et al. . |
| 3,773,495 | 11/1973 | Nilles et al. . |
| 3,861,888 | 1/1975 | Heise et al. . |
| 3,871,871 | 3/1975 | Denis et al. . |
| 3,932,172 | 1/1976 | Knuppel et al. . |
| 3,941,623 | 3/1976 | Takashina et al. . |
| 3,953,199 | 4/1976 | Michaelis . |
| 3,955,964 | 5/1976 | MacDonald et al. . |
| 3,997,335 | 12/1976 | Kolb et al. . |
| 4,004,920 | 1/1977 | Fruehan . |
| 4,081,270 | 3/1978 | Tichauer et al. . |
| 4,201,572 | 5/1980 | Slamar . |
| 4,230,274 | 10/1980 | Rymarchyk et al. . |
| 4,270,949 | 6/1981 | Esposito et al. . |
| 4,322,033 | 3/1982 | Rymarchyk et al. . |
| 4,348,229 | 9/1982 | Suemura et al. . |
| 4,349,382 | 9/1982 | Schleimer et al. . |
| 4,398,948 | 8/1983 | Emoto et al. . |
| 4,405,365 | 9/1983 | Robert . |
| 4,427,186 | 1/1984 | Buhrmann . |
| 4,434,005 | 2/1984 | Metz et al. . |
| 4,443,252 | 4/1984 | Kreijger et al. . |
| 4,473,397 | 9/1984 | Bleeck et al. . |
| 4,490,172 | 12/1984 | Moore et al. . |
| 4,533,124 | 8/1985 | Mercatoris . |
| 4,564,390 | 1/1986 | Gupta et al. . |
| 4,615,730 | 10/1986 | Tommaney . |
| 4,643,403 | 2/1987 | Burhmann et al. . |
| 4,653,730 | 3/1987 | Wunsche et al. . |
| 4,746,103 | 5/1988 | Takashiba et al. . |
| 4,971,297 | 11/1990 | Henrion et al. . |
| 4,979,997 | 12/1990 | Kobayashi et al. . |
| 4,988,079 | 1/1991 | Takahashi et al. . |
| 5,045,129 | 9/1991 | Barisoni . |
| 5,062,905 | 11/1991 | Tomita et al. . |
| 5,088,696 | 2/1992 | Desaar . |
| 5,145,533 | 9/1992 | Yoshitomi et al. . |
| 5,251,879 | 10/1993 | Floyd . |
| 5,298,053 | 3/1994 | Griffing . |
| 5,417,739 | 5/1995 | Watkins et al. . |
| 5,584,909 | 12/1996 | Kim . |

FOAMY SLAG PROCESS USING MULTI-CIRCUIT LANCE

FIELD OF THE INVENTION

The present invention relates to steelmaking in a basic oxygen furnace and, in particular, to a blowing practice during steelmaking that enhances the efficiency of post combustion heat recovery.

BACKGROUND OF THE INVENTION

Basic Oxygen Furnace (BOF) steelmaking produces, among other things, large amounts of carbon monoxide (CO) gas above the molten metal bath. This so called "off-gas" contains more potential heat than the total heat generated in the steel/slag bath by oxidation reactions. If this so called "post-combustion" heat, generated by the burning of CO to $CO_2$ above the bath, can be recaptured by the steel bath, significant energy and cost savings can be achieved. By effectively recapturing the post-combustion heat larger amounts of scrap can be charged to the bath, which would result in higher steel production yields in hot-metal-limited BOF shops. Similarly, it would enable the refining of lower cost iron ore to decrease BOF steel costs in hot-metal-rich BOF shops. Unfortunately, with current BOF practices most of the potential heat energy from the off-gas is wasted due to inefficient heat transfer between the gas and the bath. Previous attempts to capture the post-combustion energy within the BOF vessel have typically resulted in premature vessel lining failure.

In addition to the various off-gases, BOF steelmaking practices also have the tendency to generate a foamy slag. While a small amount of foamy slag can have beneficial effects on the metallurgical reactions in the BOF, foamy slag is, by its nature, potentially hazardous and generally avoided. When large amounts of foam are produced, slopping of the foam from the BOF vessel can become uncontrollable, causing yield loss as well as environmental and safety hazards. As a result, there have been many efforts made to control or minimize the production of foamy slag. Despite the numerous problems associated with foamy slag, it has nevertheless been found that it can provide a good heat transfer medium between the post-combustion heat generated by the combustion of CO to $CO_2$ and the bath. The percentage of heat generated by combusting CO gas to $CO_2$ gas that is returned to the bath is known as the heat transfer efficiency.

SUMMARY OF THE INVENTION

In accordance with the present invention there is provided a technique for making foamy slag in a controlled manner that poses no risk of yield loss, and complies with environmental regulations without undue safety risks. As a result of the intentional, but controlled formation of foamy slag, significant improvements in the heat transfer efficiency between the post-combustion gas and the melt are obtained. This has enabled the use of larger amounts of scrap in the molten charge, resulting in significant increases in steel production. Rather than having an adverse effect on the BOF vessel lining as do conventional post combustion practices, the present invention actually extends the life of the vessel refractory lining. The inventive process also generates less iron dust. Thus, the process of the invention can be used to significantly improve the BOF practice resulting in increased yields, reduced raw material costs, extended vessel lining life and improved environmental conditions.

In general form, the present invention is directed to a method of improving post-combustion heat recovery in a vessel containing a charge of molten ferrous metal and slag, and including a lance for the introduction of oxygen gas into the charge. The method includes blowing oxygen into the charge through at least one first nozzle of the lance for refining the molten metal into steel. Oxygen is blown through at least one second nozzle from at least one location spaced above the first nozzle at an oxygen flow rate effective to produce the foamy slag in an amount for obtaining a post-combustion heat transfer efficiency of at least about 40% and, in particular, about 55 to about 65% and even up to 80% or more, without appreciable overflow of the slag (i.e., slopping) from the vessel. The oxygen flow rate from the second nozzle is at a minimum at about a starting point of a peak decarburization period of the charge.

A preferred embodiment of the present method employs a double circuit lance wherein the second nozzle is disposed above the first nozzle for controlling the slag volume and generating post combustion heat. The second nozzle is preferably isolated from fluid communication with the first nozzle. The main nozzle operates normally for refining the molten metal. Oxygen may be blown from the second nozzle from a location on a shoulder formed by adjacent portions of the lance having different diameters.

Another preferred embodiment of the present invention employs a triple circuit lance. At least one second auxiliary nozzle is disposed above at least one first main nozzle. At least one third auxiliary nozzle is disposed above the first nozzle, the third nozzle preferably being disposed above the second nozzle as well. Fluid passageways extend to each of the first, second and third nozzles, so that, advantageously, all three of these nozzles and their passageways are isolated from fluid communication with each other. As a result, refining is carried out normally through the first nozzle. Oxygen is blown from the second nozzle for controlling the foamy slag. Oxygen blown from the third nozzle primarily generates post combustion heat and may be at a relatively uniform, high flow rate. As in the case of the double circuit lance, the second and third auxiliary nozzle outlets are preferably disposed on shoulders. The triple circuit lance may enable an even greater pickup of post combustion heat by the bath and may allow even more scrap to be added, compared to the double circuit lance.

In all embodiments of the invention, the volume of oxygen to be blown to reach the starting point of a peak decarburization period of the charge may be approximated. The point at which the auxiliary oxygen flow is reduced (or maintained at a low level) at about the onset of the peak decarburization period may be empirically determined or calculated.

In particular, in all embodiments of the invention a lower end of the lance may be disposed at an initial height above the molten metal prescribed by normal steelmaking practice. The lower end of the lance may be lowered from this initial height at a rate prescribed by normal steelmaking practice. Refining oxygen may be blown concurrently while adjusting the oxygen flow rate from the second nozzle to control the amount of the foamy slag. The first nozzle preferably blows oxygen gas during refining at a substantially uniform flow rate throughout the peak decarburization period. The second nozzle is preferably disposed at a height above the level of the maximum volume of foam in the vessel, which maximizes the generation of post combustion heat. The present invention preferably employs sets of the second and third auxiliary nozzles. There are at least two nozzles in each of the first and second nozzle sets. The flow from the second and third nozzles may be referred to herein as auxiliary flow. The flow from the first nozzles may be referred to herein as main flow.

Still further, the auxiliary oxygen flow may be blown at a flow rate less than about 2500 standard $ft^3$/minute at the onset of the peak decarburization period. In contrast, typical post combustion practices blow the oxygen at a maximum rate at the onset of the peak decarburization period. The auxiliary oxygen blown from the second or third nozzles is reduced to the minimum rate in a window ranging, for example, from about 39% to about 67% of cumulative main oxygen blown. The window lasts a duration in which at least about 17% of cumulative main oxygen is blown. Reference to cumulative main oxygen blown means the total volume of oxygen that has been blown up to the end of the peak decarburization period. Reference herein to the end of the peak decarburization period means the volume of main oxygen blown to produce steel having a carbon content of not greater than 0.05% by weight based upon the total weight of the composition.

The present invention offers numerous advantages. One advantage is the ability to utilize normal initial lance heights and normal lance reduction rates, which simplifies the process.

Moreover, the present invention, through the use of a multi-circuit lance, enables a blowing schedule of great flexibility. The auxiliary oxygen flow is controlled independently of the main oxygen flow. In the case of the triple circuit lance, the oxygen flow through the second nozzles may be adjusted independently of the oxygen flow through the third nozzles. Therefore, especially after the critical slopping period has passed, the flow rate from the auxiliary nozzles may be increased as desired. Different ramped or stepwise auxiliary oxygen blowing schedules may be utilized, each with different rates of oxygen flow, to maximize the post combustion heat and the heat transfer efficiency. According to the invention the molten metal may be refined at a maximum rate utilizing normal main oxygen flow, coupled with the ability to enhance the heat transfer efficiency to high levels utilizing the independent auxiliary oxygen flow, all without accelerating the deterioration of the furnace lining.

In view of the greater heat transfer efficiency, the invention enables a greater energy pickup and thus, enables FeO pellets to be added to the charge. These pellets are less expensive than scrap and enable the process to be operated at a cost savings. The iron ore pellets may be used in the present post combustion practice to reduce the need for higher scrap additions and dependence on hot metal from the blast furnace, while still maintaining the productive capacity of the BOF. The present invention also relates to reducing the main oxygen flow rate while adding the iron oxide containing material, and supplementing the reduced main oxygen flow with an inert gas. On the other hand, in hot metal limited shops, more scrap can be added due to the higher bath temperature. The invention thus offers substantial benefits in increased efficiency and decreased cost of steel production in the BOF.

Many additional features, advantages and a fuller understanding of the invention will be had from the following detailed description of preferred embodiments.

Figure 1:
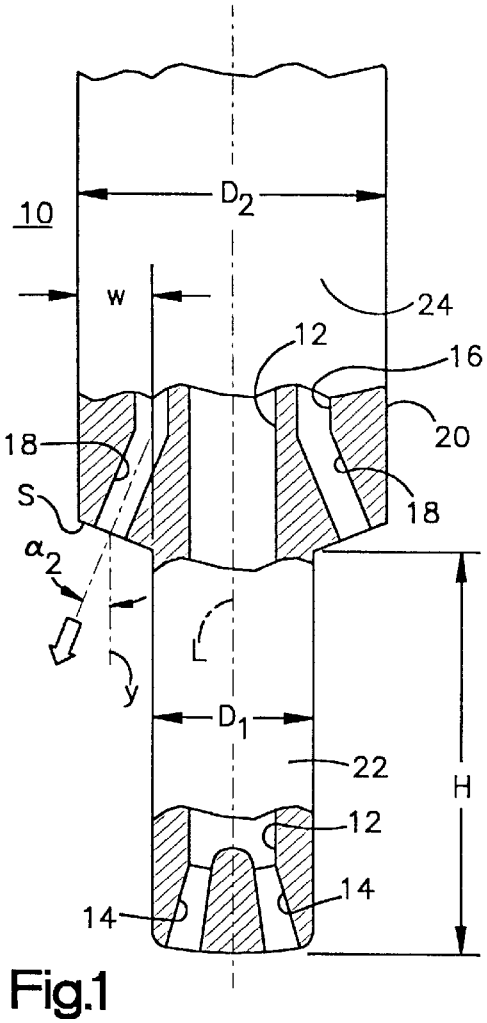
FIG. 1 is a schematic vertical cross-sectional view showing a double circuit lance suitable for use in the present invention.
Figure 2:
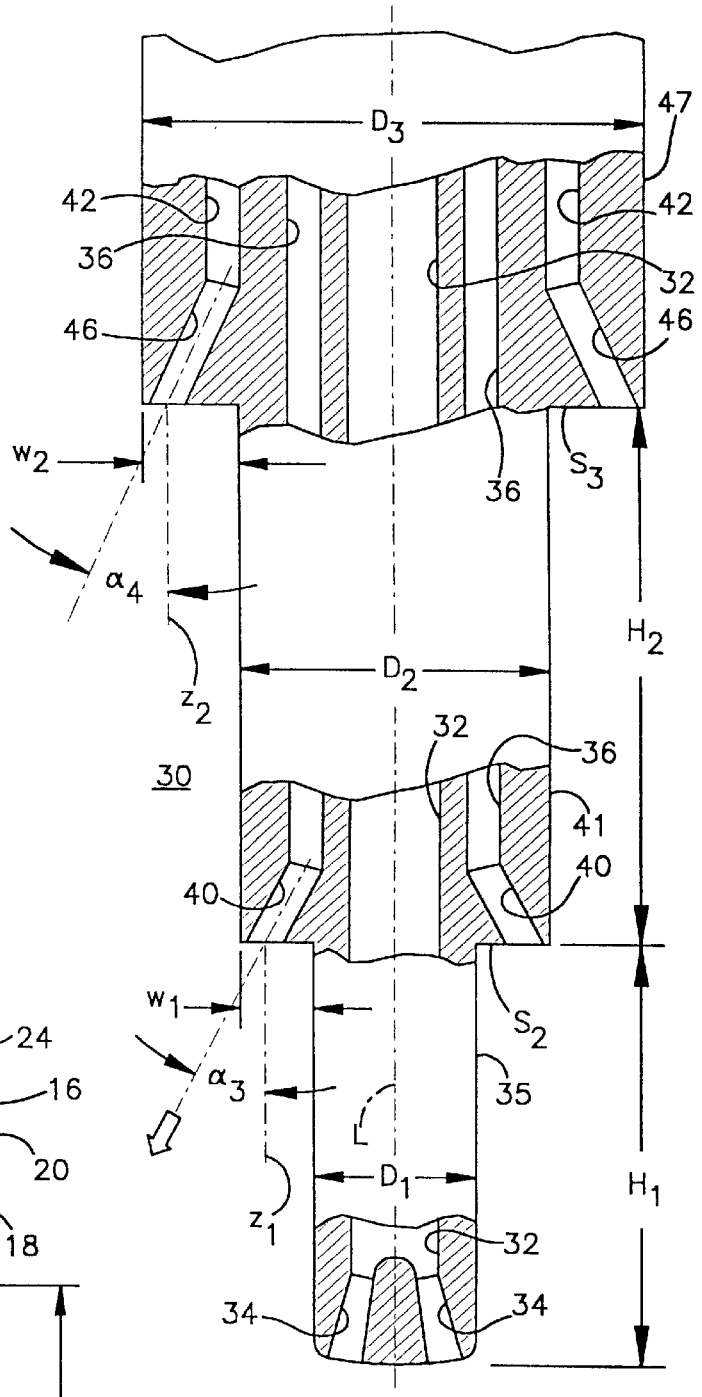
FIG. 2 is a schematic vertical cross-sectional view showing a triple circuit lance suitable for use in the present invention.

For purposes of clarity, the lances of FIGS. 1 and 2 are not shown as including passages other than for gas flow. However, the lances of FIGS. 1 and 2 may include passages for water cooling the lance in a manner known to those skilled in the art.

DETAILED DESCRIPTION OF PREFERRED EMBODIMENTS

The present invention is directed to a method of improving post-combustion heat recovery in a vessel containing a charge of molten ferrous metal and slag, and including a lance, such as the lances shown in FIGS. 1 and 2, for the introduction of oxygen gas into the charge. The process includes blowing oxygen into the charge through first or main nozzles of a lance ("main oxygen") for refining the molten metal into steel. Oxygen is blown through second or auxiliary nozzles from at least one location spaced above the main nozzles ("auxiliary oxygen"), at a flow rate effective to provide the slag with a foamy consistency. The auxiliary oxygen flow rate is effective to produce the foamy slag in an amount for obtaining a heat transfer efficiency of at least about 40% without slopping. The auxiliary oxygen flow rate is at a minimum at about a starting point of a peak decarburization period of the charge.

Oxygen is blown from the main nozzles at the lower end of the lance preferably continuously at a substantially uniform high flow rate during refining of the molten metal into steel. The main oxygen flow rate is substantially uniform at least during the peak decarburization period. The rate, volume and velocity of the main oxygen flow would be apparent to those skilled in the art in view of this disclosure. The rate at which the main oxygen is blown for refining is unaffected by the reduction in flow of the auxiliary nozzles in view of the independent main and auxiliary flow.

Typical parameters used by BOF shops to dictate the prescribed starting lance height for a normal BOF cycle include the size of the heat, the amount of scrap, vessel size and configuration, lance specifications and the like. The initial lance height according to the invention is preferably the same as that used in normal shop specifications. The actual starting height according to the invention will vary. Each BOF shop has specified operating parameters for the oxygen blowing cycle establishing starting lance height, lance height reduction rate, oxygen flow rate and the like, which typically vary from shop to shop.

In BOF's having a large charge, a relatively high lance height is normal to prevent molten metal from being blown from the BOF. Conversely, when a lesser charge is present, the lance may normally be disposed lower in the BOF. For example, a normal initial height of the bottom of the lance from the bath may be 135 inches for a 280 net ton ("NT") heat compared to a normal initial height of 100 inches for a 225 NT heat.

Most BOF shops reduce the lance height step-wise during the oxygen blowing cycle. In the practice of the invention, the lance is preferably lowered at a rate prescribed by normal steelmaking practice. That is, the invention does not require any particular lance height reduction rate to control the production of foamy slag to enhance the heat transfer efficiency while avoiding slopping.

An important feature of the present method is adjusting the rate at which oxygen is blown from the auxiliary nozzles. The flow rate of oxygen from the auxiliary nozzles is adjusted to control a foamy slag and yet prevent slopping of the molten metal. The first adjustment is to preferably lower the auxiliary oxygen flow rate at the anticipated onset of the peak decarburization period. The auxiliary oxygen flow rate is preferably decreased at or slightly before the start of the peak decarburization period. Alternatively, prior to and at the critical slopping period the auxiliary flow rate may be blown at a relatively constant low maintenance level to prevent clogging of the nozzles. After the critical slopping period, the auxiliary oxygen flow rate is increased, which maximizes the heat transfer efficiency.

Enhanced efficiency in transferring the potential heat from the post-combustion of off-gases to the molten metal charge is obtained according to the invention by intentionally forming a foamy slag, but in a controlled manner to prevent slopping. It has been observed that a high FeO content, coupled with a certain range of V-ratio, i.e., the ratio of CaO to $SiO_2$ in the slag, is conducive to foam formation. However, the practice must stay within tolerable limits from the standpoint of controlling slopping. In order to control the foamy slag it is necessary to significantly reduce the auxiliary oxygen flow rate (or maintain the auxiliary oxygen at a previously low rate) at the appropriate time during the oxygen blowing cycle. By ensuring that the auxiliary oxygen flow rate is at its minimum at about the onset of the peak decarburization period of the blowing cycle, foamy slag can be controllably produced. Upon increasing the auxiliary oxygen flow rate after the critical slopping period, post-combustion heat transfer efficiencies ranging from at least about 40% and, in many cases, from about 55% to about 65% and even to about 80% and greater, may be obtained.

According to the invention, the oxygen flow rate is adjusted to be at its minimum at about the onset of the peak decarburization period and has been reduced low enough to control the foamy slag and prevent slopping. Prior to the commencement of the peak decarburization period, at which the auxiliary oxygen flow rate will be at its minimum, one can select the auxiliary oxygen flow rates as desired to optimize the formation of foamy slag in a controlled manner while avoiding slopping to maximize the heat transfer efficiency. The critical slopping period is determined empirically for each shop depending on the amount of foam produced and the ability of the particular vessel to contain it.

It would be apparent to those skilled in the art in view of this disclosure that since the auxiliary oxygen flow rate can be adjusted independently of the main oxygen flow rate, there is a significant amount of latitude in determining the best practice for a given shop. The object, of course, is to produce enough foam to reach post-combustion heat transfer efficiency levels on the order of at least about 40%. The amount of foam necessary for this purpose can be estimated by the FeO content calculated at the commencement of the peak decarburization period. To achieve the desired heat transfer levels according to the invention there is about 10 to about 18% FeO in the slag at the onset of the peak decarburization period. Accordingly, the decrease in the auxiliary oxygen flow rate approaching the peak decarburization period can be aimed to reach an FeO content favorable to foamy slag generation.

Another factor that influences the amount of auxiliary oxygen that must be blown to attain a desired heat transfer efficiency is the carbon content of the bath. As the carbon content of the bath becomes depleted and less CO gas is released, there are less bubbles in the foamy slag and it becomes flat.

The V ratio also affects the generation of foamy slag. During a heat, the V ratio is less than about 1 initially. At a V ratio of less than 1 the slag is "glassy" due to its silica content and does not easily foam. The V ratio increases to a value of between about 1 and about 2 during the desiliconization period and into the peak decarburization period, which enables the foamy slag to be readily generated even at a relatively low auxiliary oxygen flow rate. After the critical slopping period (usually over about 215,000 SCF main oxygen consumed), as carbon is being depleted from the bath, the slag tends to become stable and nonfoamy because most of the lime is melted into solution. This raises the slag V ratio above about 2. At a V ratio greater than about 2 the slag is flat and does not readily foam. Therefore, a higher auxiliary oxygen flow rate is required to maintain a foamy slag. As the slag V ratio increases above about 2, increasing the heat transfer efficiency requires increasing the auxiliary oxygen flow rate to maintain a foamy slag. However, excessive auxiliary oxygen flow may result in slopping. Therefore, the auxiliary oxygen schedule may be adjusted dependant upon the elapsed time of the heat cycle, the condition of the slag and the carbon content of the bath. A careful determination of the auxiliary oxygen flow rate must thus be made so that the slag is foamy enough at any particular time of the heat to maximize the heat transfer efficiency and yet is not too foamy so as to cause slopping.

More specifically, since the condition of the slag changes during the heat, the auxiliary oxygen flow rate is different during different stages of the heat. Once the oxygen blowing cycle has commenced, foamy slag is produced in the vessel and maintained as the lance is lowered. During the beginning of the heat, a lower oxygen flow rate is required to generate sufficient foamy slag, because the slag foams readily.

At the critical slopping period the auxiliary oxygen content must be lowered at a predetermined time to avoid slopping. The cumulative main oxygen flow volume after which the auxiliary oxygen flow rate must be reduced to avoid slopping has been determined by empirical observations alone as ranging from about 135,000 SCF (standard cubic feet) to about 215,000 SCF, for example. Those skilled in the art would appreciate that this range of cumulative main oxygen volume may change with varying conditions in the shop such as lance height, gas velocity, heat size and melt chemistry. At or about the commencement of the peak decarburization period, also the peak slopping period, the flow rate is at a minimum. At the commencement of the peak decarburization period it is important that the flow rate minimum be low enough to allow control of the foam. This generates the maximum amount of foamy slag that can be controllably produced without slopping during the peak decarburization period, which in a typical melt lasts on the order of 3 to 5 minutes. It is preferable to blow the auxiliary oxygen at a rate above the minimum prior to the onset of the peak decarburization period and then to reduce the flow rate to the minimum as the period begins. This enables a greater post combustion heat ratio to be achieved compared to blowing the auxiliary oxygen at a relatively constant maintenance flow up to and at the critical slopping period. The post combustion heat ratio is defined herein as the percentage of CO gas that is burned to $CO_2$ gas.

After the critical slopping period, the oxygen flow rate may be gradually increased, to compensate for the condition of the slag, and to maximize post combustion heat. The auxiliary oxygen flow rate may reach a desired maximum rate prior to the end of, or shortly after, the peak decarburization period. The design constraints of the lance are the main limit upon the maximum rate of auxiliary oxygen that may be blown. Auxiliary oxygen may be blown at a maximum rate in the range of from about 4,500 to about 6,000 SCFM or more, with a rate of about 4,500 to about 5,000 SCFM being preferable (e.g., for a 280 net ton heat).

In order to generate foamy slag without slopping it is necessary to predict the peak decarburization period for a given charge since, as noted, the critical slopping period typically corresponds to the peak decarburization period. Once predicted, the auxiliary oxygen flow rate can be scheduled to be at a minimum at the commencement of the peak decarburization period.

An advantage of the present invention is that the onset of decarburization and the critical slopping period may be empirically determined without the need for any calculations, including calculating the total volume of main oxygen to be blown. Since the auxiliary oxygen can be adjusted to a higher rate later in the heat, a wide window can be opened around the anticipated critical slopping period. Reference to "window" herein means a range of cumulative main oxygen volume in which the auxiliary oxygen flow is at a minimum rate. This minimum rate is preferably a maintenance level that avoids clogging of the nozzles. This wide window need not be calculated, but may be determined empirically. The outer limits of the cumulative main oxygen volume window are set wide to avoid any likelihood of slopping based upon empirical observations. The window may range from about 39% to about 67% of the cumulative main oxygen blown up to the end of the peak decarburization period. The invention may employ a main oxygen window of about 3 minutes or more or about 80,000 SCF or more, e.g., from about 135,000 SCF to about 215,000 SCF of main oxygen. The window may last for the duration of a period in which at least about 17% of cumulative main oxygen is blown.

The multi-circuit lance design enables the auxiliary oxygen flow to be adjusted as desired, which allows great flexibility in executing the auxiliary oxygen blowing schedule. After the critical slopping period the auxiliary oxygen flow rate is raised as desired to maximize post combustion heat recovery. The auxiliary oxygen flow rate may be raised to high enough levels that compensate for employing a wide window. In this regard, especially after the critical slopping period has passed, the auxiliary oxygen may be blown according to different schedules, e.g., step wise or ramped at constant slopes, each at different auxiliary oxygen flow rates at different points during the peak decarburization cycle, to maximize the post combustion heat.

It may be desirable to calculate the point at which slopping will occur rather than or in addition to using the empirical wide main oxygen window. In this regard, the peak decarburization period starts when essentially all of the silicon in the charge is oxidized. Until that point some carbon is burned, FeO is formed, a large amount of Mn is burned, and other elements such as Ti and phosphorus are burned. The oxygen needed to reach the peak decarburization period is approximately equal to the amount of oxygen needed to oxidize these elements. Although some of these amounts are known, others are empirically calculated because the elements are only partially oxidized. From a sampling of the hot-metal being charged to the BOF vessel, the following formula can be used to approximate the oxygen volume in standard cubic feet (scf) necessary to reach the peak decarburization period for that charge.

$$\text{oxygen (scf)}=O_{Si}+O_{Fe}+O_{C}+O_{Mn}+O_{misc.} \quad \text{(I)}$$

In the above formula I, $O_{si}$ stands for the amount of oxygen needed to remove silicon from the charge, which is in turn approximately equal to 13.85 times the total weight (pounds) of silicon or 13.85 (wt. Si). The value 13.85 is a theoretical stoichiometric value for the volume of oxygen needed per pound of silicon. The total weight of silicon is contributed mostly from the hot metal, with some being contributed by silicon containing metallics such as cold iron, pig iron and the like. Thus, the value of (wt. Si) in the above calculation is derived from the relation 0.01 (% of Si in the hot metal)(weight of the hot metal)+0.01 (% Si in pig iron)(weight of pig iron).

The value of $O_{Fe}$ is the volume of oxygen needed to oxidize Fe to FeO and is approximately equal to equation (1) below:

$$O_{Fe}=2.71(\text{weight FeO}) \quad (1)$$

The value of 2.71 is again a stoichiometric value based on the volume of oxygen needed to form each pound of FeO. The weight of the FeO must be determined empirically. The weight of FeO is given by equation (2) below:

$$\text{wt. FeO}=(0.01)(\%\ \text{FeO})(\text{wt. of slag}) \quad (2)$$

The weight of the slag is approximately equal to the weight of $SiO_2$+weight of CaO+weight of FeO. The weight of $SiO_2$=2.14 (wt. Si) and weight of CaO=VR(wt. $SiO_2$). Studies have indicated that the peak decarburization is also associated with a composition favoring dicalcium silicate formation, thus the value of the so called "V-ratio" or "basicity ratio" (VR), which is the ratio of % CaO to % $SiO_2$, is set to be approximately equal to 2.0. Thus, the weight of the slag is approximated by equation (3) as follows:

$$(\text{wt. slag.})=[(\text{wt. } SiO_2)+(\text{wt. CaO})]/[0.01(100-\%\ \text{FeO})] \quad (3)$$

Combining equations (2) and (3) one approximates the weight of FeO as set forth in equation (4):

$$(\text{wt. FeO})=(\%\ \text{FeO})[2.14(\text{wt. Si})+2(2.14)(\text{wt. Si})]/(100-\%\ \text{FeO}) \quad (4)$$

The % FeO is typically on the order of about 10 to about 18% by weight based on the weight of the slag, depending on lance height and vessel geometry. The specific value to substitute in the foregoing equation is determined empirically. Thus, by combining equation (1) and equation (4), one obtains the approximate amount of oxygen required for Fe oxidation as follows:

$$O_{Fe}=2.71(\%\ \text{FeO})\ [2.14(\text{wt. Si})+2(2.14)(\text{wt. Si})]/(100-\%\ \text{FeO}) \quad (5)$$

The value of $O_c$ in formula I is the volume of oxygen needed to oxidize carbon to CO and $CO_2$ and is approximately equal to 17.87 (total C burned). The value 17.87 is the theoretical stoichiometric value to burn carbon to carbon monoxide and 10 percent carbon dioxide. The total C burned is in turn given by the formula (tot. C burned)=0.01 (Δ% C)(wt. of the hot metal). The Δ% C is the amount of carbon burned during the desiliconization period, which is empirically determined to be from about 0.7 to about 1.0%, depending on the hot metal silicon content, lance height, hot metal to scrap ratio, vessel geometry and age.

The oxygen needed to oxidize manganese to MnO ($O_{Mn}$) is approximated by the relation $O_{Mn}$=3.54 (total Mn burned). Since the manganese affinity for oxygen is less than that of Si, and the scrap is not completely melted in the early stages of the blow, Mn is not completely burned. Therefore, the total Mn burned is approximated at 50% of the total input Mn from the hot metal and scrap, such that the oxygen to oxidize Mn is equal to 3.54 (0.5) (total wt. Mn input).

In the United States, the $O_{misc.}$ term, which is the oxygen needed to oxidize titanium, phosphorus and other trace elements, can be neglected since the values are insignificant due to the quality of the raw materials. However, in Europe and Japan, the $O_{misc.}$ term may not be ignored and, if necessary, values for this term can be empirically selected.

Based on the foregoing formula, the cumulative volume of main oxygen to be blown to reach the peak decarburization period can be approximated. The cumulative volume of auxiliary oxygen that is blown need not be considered regarding when to reduce the auxiliary oxygen flow rate, since the cumulative auxiliary oxygen volume is relatively small compared to the cumulative main oxygen volume. The calculated main oxygen volume may be adjusted by using an efficiency factor of about 2%. The complete duration of the blowing cycle is of course determined by modifying the terms in the formula for the amount of oxygen necessary to completely oxidize all of the various elements depending upon the aim carbon. All of the foregoing calculations may be done by computer and input into the system for precision control of the process as would be known to those of ordinary skill in the art in view of this disclosure.

From the calculated or empirically estimated oxygen volume to reach peak decarburization, one can then modify any normally prescribed shop practice to implement the auxiliary flow rate reduction practice of the present invention to have the minimum flow rate correspond to the approximate beginning of the peak decarburization period.

BEST MODE OF CARRYING OUT THE INVENTION

The present invention is not limited to any particular post combustion lance configuration. Post combustion lances suitable for use in the present invention would be apparent to those skilled in the art in view of this disclosure. One example of a double circuit lance which may be suitable for use in the present invention is described in U.S. patent application Ser. No. 08/670,125, entitled "Preventing Skull Accumulation on a Steelmaking Lance," filed Jun. 25, 1996, which is incorporated herein by reference. The lance of the Ser. No. 08/670,125 application, although not intended to be used for post combustion, may be modified for use in the post combustion practice of the present invention, as would be appreciated by those skilled in the art in view of this disclosure.

Another lance that may be suitable for use in the present invention is shown and described in FIG. 17 of U.S. patent application Ser. No. 08/767,994, entitled "Multipurpose Lance," filed Dec. 13, 1996, which is incorporated herein by reference. The lance of the Ser. No. 08/767,994 application, although primarily intended for use as a combination slag splashing/deskulling lance, may also be modified for use in the post combustion practice of the present invention as would be appreciated by those skilled in the art in view of this disclosure.

Turning now to FIG. 1, one multi-circuit lance preferably used in the present invention is a double circuit lance 10 including a first fluid passageway 12. The first fluid passageway communicates with an oxygen feed source and to first or main nozzles 14. A second fluid passageway 16 communicates with an oxygen feed source and to second auxiliary nozzles 18 disposed above the main nozzles. The first passageway and main nozzles are isolated from fluid communication with the second passageway and auxiliary nozzles. The lance 10 includes a tubular body 20 having a first lower portion 22 and a second upper portion 24. The second portion has a larger outer diameter D2 than the outer diameter D1 of the first portion. A generally radial transition between the first and second lance portions forms the shoulder S.

The main nozzles 14 are disposed at the end of the first portion of the lance. The size, configuration and number of main nozzles is consistent with those features of main nozzles used in conventional refining. The auxiliary nozzles 18 are preferably disposed such that their outlets communicate with the shoulder S. A lance comprising a pipe having the same diameter at the main nozzles as at the auxiliary nozzles (i.e., without a step) may also be suitable for use in the present method if burning of the lance is not a problem.

Another multi-circuit lance that may be suitable for carrying out the practice of the present invention is a triple circuit lance 30 shown in FIG. 2. This lance has a first fluid passageway 32 that communicates with an oxygen feed source and to first or main nozzles 34. The main nozzles are disposed in a first portion 35 of the lance having a diameter $D_1$. A second fluid passageway 36 communicates with an oxygen feed source and to second, intermediate auxiliary nozzles 40. The auxiliary nozzles 40 are disposed in a second portion 41 of the lance having a diameter $D_2$. A third fluid passageway 42 communicates with an oxygen feed source and to third, upper auxiliary nozzles 46. The upper auxiliary nozzles 46 are disposed in a third portion 47 of the lance having a diameter $D_3$. The first diameter $D_1$ is less than the second diameter $D_2$ which is less than the third diameter $D_3$. The first, second and third passageways and main, intermediate and upper nozzles are isolated from fluid communication with each other internally within the body of the lance.

The triple circuit lance includes a lower stepped portion having a shoulder S2 and an upper stepped portion having a shoulder $S_3$. The shoulder $S_2$ extends generally radially between the first and second lance portions 35, 41, while the upper shoulder $S_3$ extends generally radially between the second and third lance portions 41, 47. The shoulders $S_2$ and $S_3$ may be "square," i.e., disposed at 90° with respect to the axes $z_1$ and $z_2$ as shown in FIG. 2. Alternatively, as shown in FIG. 1, the shoulders may have other configurations and may be disposed at an angle with respect to the axis y. The auxiliary nozzles may extend into direct communication with their associated shoulder in the manner shown in FIGS. 1 and 2.

The lances 10, 30 communicate with an appropriate hose/valve apparatus and a gas supply in a manner that would be appreciated by those skilled in the art in view of this disclosure. The lance also includes water cooling pipes throughout its interior (not shown) as known to those skilled in the art.

The stepped lance configurations may enable oxygen gas to flow down the entire length of the lance. In the case of the lance shown in FIG. 1, auxiliary oxygen gas may flow down the first lance portion 22 to the main nozzles 14, since the diameter of the first portion 22 is smaller than that of the second portion 24. Similarly, in the triple circuit lance auxiliary oxygen gas may flow along the second portion 41 since it has a smaller diameter than the third portion 47, and may also flow from the second portion 41 along the smaller diameter first portion 35.

A predetermined shoulder-to-angle relationship is established in the double and triple circuit lances 10, 30 between the auxiliary nozzle angles and the shoulder widths. This relationship is defined herein as that which avoids excessive heating of the lance body and avoids deterioration of the furnace lining. Heating of the lance body is excessive if, as a result, "scarfing" occurs, i.e., the lance is burned or deteriorated by the oxygen stream. The shoulder-to-angle relationship may be influenced by other factors such as the number, location and size of the auxiliary nozzles, the concentration of oxygen in the gas, the flow rate and velocity of the gas and the lengths H, $H_1$ and $H_2$ between the shoulder and the bottom of the lance.

The shoulder width w should not be of a size that increases the weight of the lance excessively or otherwise exceeds design constraints. By constructing the lance with auxiliary nozzle angles and shoulder widths that satisfy the shoulder-to-angle relationship and by operating the lance according to the practice of the present invention, substantially no skull accumulates on the lance, lance "scarfing" and furnace erosion are avoided and the post combustion ratio is maximized.

The shoulder may have any width w that satisfies the shoulder-to-angle relationship of the present invention. The auxiliary nozzle angles and shoulder widths may vary from one stepped portion to another. Shoulder widths may range from about ½ inch to about 3 inches or more. A shoulder width of about 2 inches is preferred.

Both the double circuit lance 10 and the triple circuit lance 30 preferably have auxiliary nozzle angles $\alpha_2$, $\alpha_3$ and $\alpha_4$, each ranging from about 20° to about 30° with respect to their associated axis y, z. A nozzle angle ranging from about 22° to about 24° is most preferable. At an auxiliary nozzle angle of about 20° , the shoulder width may need to be increased to avoid scarfing of the lance. At an auxiliary nozzle angle of greater than about 30° there is a risk of burning the refractory furnace lining.

The height of the auxiliary nozzles from the tip of the lance is an important aspect of the present invention. In the case of the double circuit lance, the shoulder S is disposed a distance in the range of from about 2 to about 8.5 feet or more from the lowermost portion of the lance, with a spacing of at least about 7.5 feet being preferred. In the case of the triple circuit lance, the intermediate shoulder $S_2$ is disposed a distance in the range of from about 2 to about 8.5 feet or more from the lowermost portion of the lance, with a spacing of about 6 feet being preferred. The shoulder $S_3$ of the triple circuit lance is disposed from the lowermost portion of the lance by an distance greater than about 6 feet from the bottom of the lance and preferably, ranging from about 8.5 feet to about 9 feet or more. Those skilled in the art would appreciate that the above heights of the auxiliary nozzles and shoulders are exemplary and may be adjusted depending upon various factors, including the magnitude of the heat transfer efficiency and the post combustion ratio that are desired, and considerations of preventing deterioration of the furnace lance and lining.

It is preferable that the auxiliary nozzles employed for carrying out the majority of the post combustion function be located above the surface of the foamy slag. It is believed that a higher post combustion ratio may be attained if the auxiliary oxygen is blown above the maximum level of the foamy slag. Therefore, the nozzle heights may be selected for this purpose and modified depending upon the particular shop and blowing schedule. For example, when using the double circuit lance at an auxiliary nozzle height of 2 feet, the slag is foamy but the amount of oxygen utilized for post combustion is limited. Therefore, auxiliary nozzle heights of at least 6 feet and about 7.5 feet and greater, are preferable.

The following provides exemplary design criteria of the lance assemblies. The lances may be any suitable length and are preferably constructed of steel. The pipes of the lance may have any suitable diameter. For example, the first and second lance portions 22, 24 may have diameters of 10 inches and 14 inches (a 2 inch shoulder), respectively, or 10 inches and 16 inches (a 3 inch shoulder), respectively. The main and auxiliary nozzle orifices may be any suitable diameter. For example, the auxiliary nozzle orifices may be about ½ inch in diameter and the main nozzle orifices may be about 2 inches in diameter. The main oxygen velocity is conventional, such as Mach 2.3. The number of auxiliary nozzles may be varied. For example, 10, 14 and 20 auxiliary nozzles may be used. The auxiliary nozzle velocity ranges, for example, from about Mach 0.55 to about Mach 1.15.

When conducting the practice of the invention using the double circuit lance 10, the lance is connected to a hose/valve assembly leading from a gas source, in the well known manner. Oxygen gas is blown down the main fluid passageway 12 to the main nozzles 14 in a manner known to those skilled in the art. The auxiliary gas is blown through the auxiliary fluid passageway 16 to the auxiliary nozzles 18 which are isolated from fluid communication with the main nozzles 14. The gas is blown from the main nozzles 14 continuously at a substantially uniform flow rate from the beginning to the end of the refining process. The auxiliary gas is directed by the auxiliary nozzles 18 for post combustion and for foamy slag control. Refining oxygen is blown from the main nozzles concurrently while adjusting the oxygen flow rate from the auxiliary nozzles to regulate the amount of the foamy slag.

In the operation of the practice of the invention using the triple circuit lance 30, the lance is connected to a hose/valve assembly leading from a gas source, in the well known manner. Oxygen gas is blown down the main fluid passageway 32 to the main nozzles 34 in a manner known to those skilled in the art. The gas is blown from the main nozzles continuously at a substantially uniform flow rate from the beginning to the end of the refining process. Oxygen is blown from the fluid passageway 36 through the intermediate auxiliary nozzles 40 and from the auxiliary fluid passageway 42 through the upper auxiliary nozzles 46.

In the triple circuit lance, the oxygen from the intermediate auxiliary nozzles functions primarily to control the foamy slag. The intermediate auxiliary nozzles 40 function, for example, so that preferably about 90% of the oxygen volume blown by them is utilized for foamy slag control. The remaining oxygen blown from the intermediate nozzles may have an effect upon post combustion. The oxygen from the upper nozzles 46 functions primarily to effect post combustion. For example, the upper auxiliary nozzles may function so that preferably about 90% of the volume of oxygen blown by them will be consumed for post combustion. The remaining oxygen blown by the upper nozzles may have an effect upon the condition of the foamy slag.

It has been determined that the process of the invention using either the double or triple circuit lance, is carried out so that about 30% to about 50% of the cumulative auxiliary oxygen volume blown is effective for controlling the foamy slag and about 50 to about 70% of the cumulative auxiliary oxygen volume blown is effective for post combustion. That is, these percentages of auxiliary oxygen may be consumed for the purposes set forth. Reference to the cumulative auxiliary oxygen volume herein means the total volume of auxiliary oxygen that is blown to the end of the peak decarburization period. More preferably, at least about 33% of the cumulative auxiliary oxygen volume is effective for creating and maintaining a foamy slag while less than about 67% of the cumulative auxiliary oxygen volume is effective for post combustion. Using greater than about 70% of the cumulative auxiliary oxygen volume for post combustion may lead to slopping. Using less than about 30% of the cumulative auxiliary oxygen volume for controlling the foamy slag may result in insufficient foam generation and as a result, reduced heat transfer efficiency, possibly accelerating deterioration of the furnace lining.

The lances used in the present invention are substantially skull free. In this regard, while not wanting to be bound by theory, it is believed that skull accumulation on the lance may be prevented by the mechanisms addressed in the Ser. No. 08/670,125 application. However, prevention of skull accumulation on the lance is believed to be primarily due to a thermal expansion mechanism. That is, at the high temperatures involved in the post combustion process of the present invention, the steel pipes of the lance expand. As the lance cools, the pipes contract to their original dimensions. Any skull that adheres to the lance while it is hot and expanded, falls off or can be easily removed when the lance contracts upon cooling.

The practice of the foregoing method has resulted in both an increased post-combustion ratio of several percent and a significant increase in the post-combustion heat transfer efficiency. The final steel temperature is increased, for example, by at least about 140° F. according to the practice of the present invention. In a typical BOF practice, the post-combustion ratio is on the order of about 8%, with about 25% of the heat being recaptured by the bath (heat transfer efficiency). According to the practice of the invention, the post cumbustion ratio of CO burned to $CO_2$ ranges from about 16.5% to about 17% or more. The heat generated by post combustion that is transferred back to the bath ranges from at least about 55%, and more preferably, from about 60% to about 65% and even up to about 80% or more.

In a 275 NT heat, for example, using a double circuit lance, a post combustion ratio of about 17% and a heat transfer efficiency of about 65% roughly correspond to an increase of 18 million BTUs compared to the normal practice. That is, the present invention results in 22 million BTUs or more being picked up by the bath compared to a pickup of 4 million BTUs in a typical heat without post combustion. This enables at least about 4% more scrap to be added in % by weight. Utilizing the triple circuit lance may correspond to a pickup of about 24 to 25 million BTUs or more, which may enable the amount of added scrap to be increased by at least about 5% by weight.

The present invention also enables FeO pellets to be added to the charge. These pellets are less expensive than scrap and enable the process to be operated at a cost savings. The heat pickup of the bath facilitates using these pellets. In hot metal limited shops, of course, more scrap can be added to conserve the hot metal.

The method of the present invention may be modified according to the process disclosed in the patent application filed Apr. 17, 1997, entitled "Basic Oxygen Process with Iron Oxide Pellet Addition," which is incorporated herein by reference in its entirety. In this regard, the main oxygen flow rate may be reduced and nitrogen gas may be substituted for the reduced portion of the main oxygen flow, resulting in a total flow that remains substantially the same as that designed to maintain the integrity of the jet with resulting maximum penetration and turbulence of the melt.

The following provides one non-limiting example of the process of the present invention when using iron ore pellets and reduced main oxygen flow. Nitorgen gas may be added to the main oxygen flow during the critical slopping period (e.g., about 6 minutes into the blow). An FeO containing pellet feed of about 3000 pounds per minute may be used for a total of about 10,000 pounds. About 230 oxygen units total may be used. It would also be appreciated by those skilled in the art that the post combustion practice of the invention may utilize iron ore pellets without supplementing a decreased main oxygen flow with an inert gas. In this case as well as when using the inert gas, after peak decarburization (e.g., 330,000 main oxygen volume), at least about 15% of the total oxygen volume should be due to a minimum maintenance flow rate from the auxiliary nozzles to reduce excess amounts of FeO in the slag to normal levels at turndown.

Yet another advantage is that the large amount of foamy slag produced by the method coats the furnace refractory and as a result, is believed to inhibit deterioration of the furnace Lining. The method also results in reduced iron dust generation. These and other advantages and a better understanding of the invention will be appreciated from the following non-limiting examples.

EXAMPLE 1

A 280 NT heat was charged into a BOF vessel. The capacity of the vessel when newly lined was 6,837 cubic feet. This vessel had been used for 5000 heats. The hot metal had a weight of 428,000 lbs. The hot metal composition comprised, in % by weight: 0.88% silicon, 0.30% manganese, 0.001% sulfur and 0.049% phosphorus, with the amount of carbon assumed to be at a saturated level for the composition, the balance being iron and other unavoidable impurities. The hot metal temperature was 2457° F. The charge also included 197,000 lbs. scrap, 27,000 lbs. burnt lime and 15,700 lbs. dolomitic lime, and did not require any fluorspar.

The double circuit lance of FIG. 1 was used. The oxygen volume through the main nozzles to reach an aim carbon content of the melt at turndown of 0.035% was calculated as 445,000 std. $ft^3$ for the oxygen blowing sequence. The aim temperature was 2965° F. The approximate main oxygen volume needed to reach the peak decarburization period for this charge was estimated empirically.

The blow time, lance height and main oxygen flow rate are shown by the following Table 1.

TABLE 1

| Blow Time (minutes) | Lance Height (inches) | Main $O_2$ Flow Rate (SCFM) |
|---|---|---|
| 0 ~ 1 | 135 | 25,000 |
| 1 ~ 2 | 115 | 25,000 |
| 2 ~ 5 | 95 | 25,000 |
| 5 ~ 12 | 85 | 25,000 |
| 12 ~ End (17 min 24 sec) | 75 | 25,000 |

The blow time and auxiliary oxygen flow rate is shown by the following Table 2.

TABLE 2

| Blow Time (minutes/seconds) | Aux. $O_2$ Flow Rate (SCFM) |
|---|---|
| 0 ~ 4/0 | 1,300 |
| 4/0 ~ 5/24 | 2,800 |
| 5/24 ~ 8/36 | 1,600 |
| 8/36 ~ 9/7 | 2,400 |
| 9/7 ~ 9/36 | 3,200 |
| 9/36 ~ 10/5 | 4,400 |

TABLE 2-continued

| Blow Time (minutes/seconds) | Aux. $O_2$ Flow Rate (SCFM) |
|---|---|
| 10/5 ~ 13/36 | 5,000 |
| 13/36 ~ 13/43 | 3,500 |
| 13/43 ~ 13/50 | 2,200 |
| 13/50 ~ 17/24 | 1,300 |

The total amount of main oxygen actually blown until the end of the peak decarburization period (e.g., 13 minutes, 50 seconds) was about 346,000 standard cubic feet. The total amount of auxiliary oxygen actually blown in that time was about 37,400 standard cubic feet. The auxiliary oxygen was dropped to the 1,600 minimum after 135,000 SCF (39%) of main oxygen was blown, marking the beginning of the main oxygen flow volume window. The auxiliary oxygen was increased after 215,000 SCF of main oxygen (62%) was blown. This corresponds to a main oxygen window that lasts a duration of about 23% of the volume of main oxygen blown to reach the end of the peak decarburization period. A stepped auxiliary blowing schedule was used: 2,400, 3,200, 4,400 and 5,000 SCFM.

The final actual bath temperature was 2953° F. and the actual bath composition in % by weight at turndown, comprised: 0.0322% carbon, 0.008% sulfur and 0.005% phosphorus, the balance being iron and other unavoidable impurities. The slag had the following final composition in % by weight: 23.75% FeO, 41.52% CaO, 13.19% $SiO_2$, 8.03% MgO, 0.84% $Al_2O_3$, 2.57% MnO, 0.68% $P_2O_5$ and 0.06% S.

The foregoing blowing practice created a foamy slag in the BOF vessel with no slopping, and resulted in a post-combustion heat transfer efficiency of approximately 65% and a post-combustion ratio of about 16.5%.

EXAMPLE 2

Another heat was conducted according to the oxygen blowing schedule of the invention at main and auxiliary rates and volumes shown by the following Table 3.

TABLE 3

| Cumulative Main Oxygen Blown (SCF) | Aux. $O_2$ Flow Rate (SCFM) | Reaction |
|---|---|---|
| 0 ~ 95,000 | 1,300 | DeSi |
| 95,000 ~ 135,000 | 2,800 | DeSi |
| 135,000 ~ 215,000 | 1,500 | Peak Decarb |
| 215,000 ~ 230,000 | 2,100 | Peak Decarb |
| 230,000 ~ 250,000 | 3,100 | Peak Decarb |
| 250,000 ~ 310,000 | 4,500 | Peak Decarb |
| 310,000 ~ 320,000 | 3,500 | Peak Decarb |
| 320,000–end | 1,300 | Final |

The double circuit lance of FIG. 1 was used in the above heat and the auxiliary nozzles were rated at a Mach number of 0.56 at a flow rate of 5,000 SCFM. The lance had 20 auxiliary nozzles and a step length of about 7.5 feet. The lance height, reduction rate and the main oxygen blowing practice were the same as used during normal refining.

At the beginning of the oxygen blowing, the auxiliary oxygen was at a minimal maintenance flow rate of 1,300 SCFM to prevent any port blockage. Toward the end of the desiliconization period, the auxiliary flow rate was increased to 2,800 SCFM to generate an adequate level of foam. Earlier generation of foam, if desired, may utilize a higher auxiliary flow rate (e.g., above 4000 SCFM) because of the lower basicity ratio and lower CO generation rate. When the higher auxiliary flow rate is employed, foam generation becomes almost instantaneous.

As the critical slopping period in the early peak decarburization period approached, foam generation became self-sustaining because of the higher basicity ratio (typically between 1 and 2) and CO generation rate. The amount of main oxygen to be blown before reducing the auxiliary oxygen flow rate was estimated empirically to be 135,000 SCFM. The auxiliary flow rate was reduced to 1,500 SCFM after blowing 135,000 SCF of the main oxygen for reaching the end of the peak decarburization period, to avoid excess foam formation. Thus, the auxiliary oxygen flow was reduced after about 42% (135,000/320,000) of the total amount of main oxygen needed to reach the end of the decarburization period was blown. The auxiliary oxygen was increased from the minimum flow rate after about 67% (215,000/320,000) of main oxygen volume needed to reach the end of the peak decarburization period. Thus, the window in which the auxiliary oxygen was minimum, lasted a duration in which at least about 25% ((215,000–135,000)/320,000) of cumulative main oxygen was blown.

In the latter part of the peak decarburization period, as more fluxes were melted for a higher basicity ratio and the slag became stabilized, the auxiliary flow was gradually increased to 4,500 SCFM to obtain a higher post combustion ratio and to maintain a foamy condition. During the final period the auxiliary minimum reduced to a minimum due to lack of CO gas and to avoid deteriorating the furnace lining.

Utilizing the auxiliary nozzle blowing schedule set forth in Table 3 resulted in a heat transfer efficiency of at least about 55%. A bath temperature pickup of 110° F. was able to be attained. This enabled the amount of scrap that was added to be increased by at least 3% by weight without slopping or furnace lining wear.

EXAMPLE 3

Another heat was conducted according to the oxygen blowing schedule through the main and auxiliary nozzles shown by the following Table 4.

TABLE 4

| Cumulative Main $O_2$ Blown (SCF) | Aux. $O_2$ Flow Rate (SCFM) | Reaction |
|---|---|---|
| 0 ~ 100,000 | 1,300 | DeSi |
| 100,000 ~ 135,000 | 2,800 | DeSi |
| 135,000 ~ 215,000 | 1,600 | Peak Decarb |
| 215,000 ~ 228,000 | 2,400 | Peak Decarb |
| 228,000 ~ 240,000 | 3,200 | Peak Decarb |
| 240,000 ~ 252,000 | 4,400 | Peak Decarb |
| 252,000 ~ 340,000 | 5,000 | Peak Decarb |
| 340,000 ~ 343,000 | 3,500 | Peak Decarb |
| 343,000 ~ 346,000 | 2,200 | Peak Decarb |
| 346,000–End | 1,300 | Final |

The double circuit lance shown in FIG. 1 was used. After 135,000 SCF of main oxygen was blown, the auxiliary oxygen flow rate was reduced to 1600 SCFM. Thus, the auxiliary oxygen was reduced after about 39% (135,000/346,000) of the total amount of main oxygen needed to reach the end of the decarburization period was blown. The auxiliary oxygen was increased from the minimum flow rate after about 62% (215,000/346,000) of the main oxygen volume needed to reach the end of the peak decarburization period was blown. Thus, the window lasted a duration in which at least about 23% ((215,000–135,000)/346,000) of cumulative main oxygen was blown. The present invention may employ different upper and lower main oxygen volumes for delineating the window, as well as different amounts of main cumulative oxygen blown to the end of the peak decarburization period, and thus, windows of a different duration at different periods of the heat, as would be appreciated by those skilled in the art in view of this disclosure. The total cumulative main oxygen volume blown varies with the desired carbon content of the melt.

As the heat progresses beyond the slopping period (typically over 215,000 standard cubic feet of oxygen being consumed) in this and in the foregoing examples, the slag becomes stable and non-foamy under the normal blowing conditions because most of the lime is melted into solution raising the slag V ratio and since carbon is depleted from the bath. At this time, the auxiliary flow must be increased to revive the foaminess of the slag. However, excessive auxiliary oxygen flow will result in slopping. Therefore, there is a particular level of auxiliary flow, which varies depending upon the time of the heat cycle, the condition of the slag and the carbon content of the bath. About 33% of the cumulative auxiliary oxygen volume is believed to have been consumed in making the slag foamy, while the remaining about 67% of the cumulative auxiliary oxygen volume is believed to have reacted in the post combustion of CO gas.

Compared to Example 2, the auxiliary oxygen flow rate was higher after the onset of the peak decarburization period. The heat transfer efficiency was at least about 55%, without which the additional post combustion heat would have damaged the refractory lining. The foregoing auxiliary oxygen blowing schedule enabled more scrap to be added than in Example 2. According to this Example, 4% more scrap by weight was added to the charge compared to a normal heat. That is, 22% by weight of scrap is added in a normal heat without conducting post combustion, whereas 26% by weight of scrap was added using the above oxygen blowing practice of the present invention.

EXAMPLE 4

The following exemplifies an oxygen blowing practice according to the present invention using the triple circuit lance. The intermediate nozzles 40 may initially blow oxygen at a maintenance flow of about 1,000 SCFM, to avoid clogging of the nozzles. The intermediate flow may then be increased during the desiliconization period so as to range from about 1,600 to about 1,700 SCFM. At the critical slopping period at about the onset of the peak decarburization period, the intermediate flow may be reduced to about 1,000 SCFM. Alternatively, the intermediate oxygen may be blown at a maintenance level prior to and at the critical slopping period. The intermediate flow may gradually be increased to a maximum of about 3,000 SCFM by the end of the peak decarburization period. The auxiliary oxygen flow from the upper nozzles may be at a maintenance level of about 1,000 SCFM before and after the peak decarburization period. During the peak decarburization period the upper auxiliary oxygen flow may be about 5,000 SCFM or more.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of improving post-combustion heat recovery in a vessel containing a charge of molten ferrous metal and slag, and including a lance for the introduction of oxygen gas into said charge, said method comprising:

blowing oxygen gas into said charge through at least one first nozzle of said lance for refining the molten metal into steel;

blowing oxygen gas through at least one second nozzle of said lance from at least one location spaced above said first nozzle at a secondary oxygen flow rate; and adjusting said secondary oxygen flow rate effective to produce foamy slag in an amount for obtaining a post-combustion heat transfer efficiency of at least about 40% and to avoid appreciable overflow of said slag from the vessel.

2. The method of claim 1 wherein a lower end of said lance is disposed at an initial height above the molten metal at a starting point of a peak decarburization period of said charge, and thereafter is lowered from said initial height while said oxygen gas is being blown from said first nozzle.

3. The method of claim 1 wherein oxygen gas is blown from said first nozzle simultaneously while adjusting said secondary oxygen flow rate to regulate the amount of said foamy slag.

4. The method of claim 1 wherein said oxygen gas is blown from said first nozzle at a substantially uniform flow rate throughout a peak decarburization period of said charge.

5. The method of claim 1 comprising blowing oxygen from said second nozzle at a rate effective to produce a heat transfer efficiency of at least about 55%.

6. The method of claim 1 wherein said second nozzle is disposed at a height above a maximum level of foamy slag in the vessel.

7. The method of claim 1 comprising blowing oxygen gas from said second nozzle to produce an FeO content in said foamy slag in an amount ranging from about 10% to about 18% by weight based on the weight of said slag at a starting point of a peak decarburization period of said charge.

8. The method of claim 1 wherein oxygen is blown from said second nozzle from a location on a shoulder formed by adjacent portions of the lance having different diameters.

9. The method of claim 1 wherein said secondary oxygen flow rate is less than about 2,500 standard $ft^3$/minute at a starting point of a peak decarburization period of said charge.

10. The method of claim 1 wherein said secondary oxygen flow rate comprises blowing said oxygen gas from said second nozzle at an initial flow rate and then adjusting the flow rate of said oxygen gas from said initial flow rate to a minimum flow rate at a starting point of a peak decarburization period of said charge.

11. The method of claim 1 wherein said secondary oxygen flow rate is adjusted to a minimum flow rate during a period in which about 39% to about 67% of cumulative main oxygen gas is blown.

12. The method of claim 1 wherein said secondary oxygen flow rate is adjusted to a minimum flow rate during a period in which at least about 17% of cumulative main oxygen gas is blown.

13. The method of claim 1 wherein at least about 30% of the oxygen blown from said second nozzle is utilized for controlling said foamy slag.

14. The method of claim 1 wherein not greater than about 70% of the oxygen blown from said second nozzle is utilized for generating post combustion heat.

15. A method of improving post-combustion heat recovery in a vessel containing a charge of molten ferrous metal and slag, and including a lance for the introduction of oxygen gas into said charge, said method comprising:

positioning a lower end of said lance at an initial height above the molten metal;

blowing oxygen gas into said charge through at least one first nozzle of said lance for refining the molten metal into steel;

lowering said lance;

blowing oxygen gas through at least one second nozzle of said lance from at least one location spaced above said first nozzle at a secondary oxygen flow rate; and adjusting said secondary oxygen flow rate effective to produce said foamy slag in an amount for obtaining a post-combustion heat transfer efficiency of at least about 40% and to avoid appreciable overflow of said slag from the vessel.

16. The method of claim 15 wherein said second nozzle is isolated from fluid communication with said first nozzle.

17. The method of claim 15 wherein said oxygen gas is blown from said first nozzle at a substantially uniform flow rate throughout a peak decarburization period of said charge.

18. The method of claim 15 wherein said second nozzle is disposed at a height above a maximum level of foamy slag in the vessel.

19. The method of claim 15 comprising blowing oxygen gas from said second nozzle to produce an FeO content in said foamy slag in an amount ranging from about 10% to about 18% by weight based on the weight of said slag at a starting point of a peak decarburization period of said charge.

20. The method of claim 15 wherein oxygen is blown from said second nozzle from a shoulder formed by adjacent portions of the lance having different diameters.

21. The method of claim 15 wherein the secondary oxygen flow rate is less than about 2500 standard $ft^3$/minute at the onset of a peak decarburization period of said charge.

22. The method of claim 15 wherein said secondary oxygen flow rate is adjusted to a minimum flow rate during a period in which at least about 17% of cumulative main oxygen gas is blown.

23. A method of improving post-combustion heat recovery in a vessel containing a charge of molten ferrous metal and slag, and including a lance for the introduction of oxygen gas into said charge, said method comprising:

blowing oxygen gas into said charge from at least one first nozzle of said lance to refine the molten metal into steel;

blowing oxygen gas from at least one second nozzle of said lance at a location spaced above said first nozzle at a secondary oxygen flow rates;

adjusting said secondary oxygen flow rate effective to produce foamy slag in an amount for obtaining a post-combustion heat transfer efficiency of at least about 40% and to avoid appreciable overflow of said slag from the vessel; and blowing oxygen gas from at least one third nozzle of said lance for effecting post combustion, said third nozzle being spaced above said first nozzle, and said first nozzle, said second nozzle and said third nozzle being isolated from fluid communication with each other.

24. The method of claim 23 wherein said oxygen gas is blown from said first nozzle at a substantially uniform flow rate throughout a peak decarburization period of said charge.

25. The method of claim 23 comprising blowing said oxygen gas from said second nozzle to produce an FeO content in said foamy slag in an amount ranging from about 10% to about 18% by weight based on the weight of said slag at a starting point of a peak decarburization period of said charge.

26. The method of claim 23 wherein said second and third nozzles are disposed at heights above a maximum level of foamy slag in the vessel.

27. The method of claim 23 wherein at least two shoulders are formed by adjacent portions of the lance having different diameters, and oxygen is blown from said second nozzle from one of said shoulders and oxygen is blown from said third nozzle from another one of said shoulders.

28. The method of claim 23 wherein said secondary oxygen flow rate is adjusted to a minimum flow rate during a period in which at least about 17% of cumulative main oxygen gas is blown.

29. The method of claim 1 comprising adding iron oxide containing material to the charge.

30. The method of claim 1 comprising feeding iron oxide containing material into the vessel after oxygen has begun to be blown from said first nozzle, reducing the flow rate of oxygen from said first nozzle during feeding, and replacing oxygen from said main nozzle with inert gas in an amount such that the integrity of the jet flow from said first nozzle and its penetration into the charge is substantially unchanged.

* * * * *